United States Patent [19]

King

[11] Patent Number: 4,913,407

[45] Date of Patent: Apr. 3, 1990

[54] PRECIOUS METAL RECOVERY SYSTEM

[75] Inventor: Barton King, Dahlonega, Ga.

[73] Assignee: International Mineral Resources, Inc., Ocean City, N.J.

[21] Appl. No.: 207,315

[22] Filed: Jun. 15, 1988

[51] Int. Cl.[4] ..... C22B 11/10; C22B 11/12

[52] U.S. Cl. ..... 266/148; 75/81; 75/83; 209/10; 209/42; 209/184; 209/193; 209/205; 266/169

[58] Field of Search ..... 209/1, 2, 3, 10, 12, 209/14–16, 41, 42, 50, 51, 162, 172, 173, 174, 175, 183, 184, 189, 190, 192–194, 198, 199, 201, 205, 206, 444, 451–453; 75/81, 83; 266/148, 152, 169, 205; 210/446, 512.3

[56] References Cited

U.S. PATENT DOCUMENTS

| | | | |
|---|---|---|---|
| 224,368 | 2/1880 | Wilkins | 209/183 |
| 611,506 | 9/1898 | Plant | 209/205 |
| 937,356 | 10/1909 | Bennett | 266/148 X |
| 1,052,157 | 2/1913 | Luckenbach | 209/189 |
| 1,986,778 | 1/1935 | Hinkley | 209/452 |
| 2,086,322 | 7/1937 | Ulrich | 209/12 |
| 2,190,632 | 2/1940 | Culmer | 209/190 |
| 4,032,122 | 6/1977 | Anders | 266/169 |

FOREIGN PATENT DOCUMENTS

| | | | |
|---|---|---|---|
| 0017386 | of 1898 | United Kingdom | 209/205 |

OTHER PUBLICATIONS

"*Elements of Ore Dressing*", Taggart, pp. 334–336, 1951.

Advertisement entitled "Micron Gold Amalgamation", *Popular Mining Magazine,* frontis page and pp. 29–32, Feb. 1984.

Signed statement dated Jul. 13, 1987 to the effect that Alvin C. Hurd and not William A. McDaniel is the inventor and builder of the HB 1500 MGA and HB 2000 HGA Amalgamators.

*Brazilian Application*–filed Aug. 6, 1987, No. PI 8704020, at the Brazilian Patent Office, this application is still pending; translation herewith provided.

*Primary Examiner*—Margaret A. Focarino
*Assistant Examiner*—Edward M. Wacyra
*Attorney, Agent, or Firm*—Perman & Green

[57] ABSTRACT

A precious metal recovery system utilizing an amalgamation process which results in substantially complete recovery both of the precious metal sought and of the mercury utilized in the process. Mercury has undesirable health and environmental characteristics and the system of the invention assures its substantial containment. In the operation of the system, ore is classified and sorted out into a plurality of bins or holds containing ore having a substantially uniform particle size. The ore is then delivered, bin by bin, beginning with the smallest particle size, to apparatus which assures substantially complete amalgamation of all of the precious metal present in the ore. Thereafter, a resulting slurry of water and tails is first removed from the amalgamation apparatus and any residual mercury removed before its return to the environment. At the end of a period of operation of the amalgamation apparatus, the mercury and precious metal amalgam mixture together with any residual tails are drawn off and subjected to three separation operations. First, the mercury and precious metal amalgam mixture is separated from any residual tails. Next, the mercury is separated from the precious metal amalgam. Finally, the mercury is removed from the amalgam thereby resulting in a reasonably pure form of the precious metal.

30 Claims, 10 Drawing Sheets

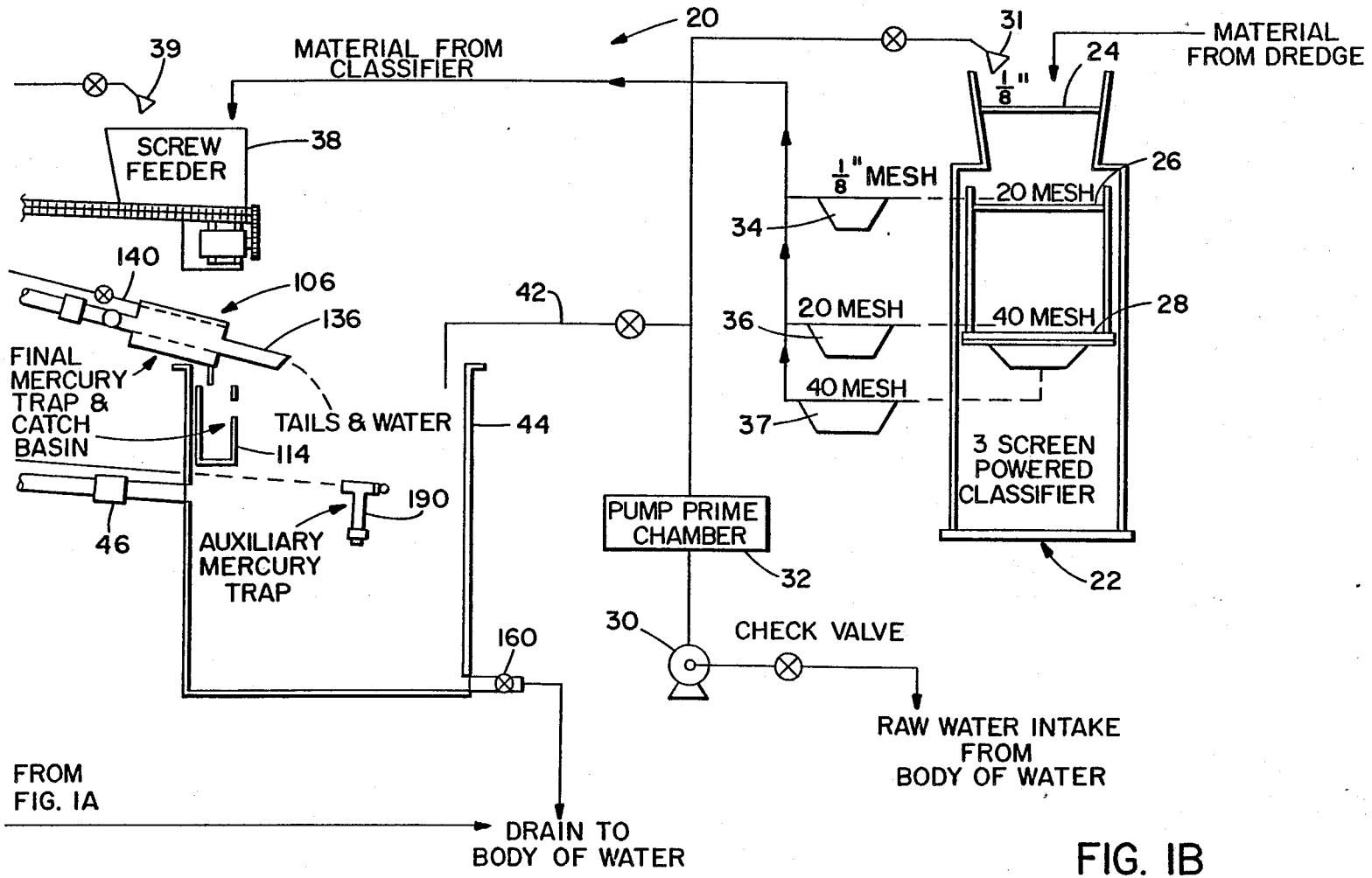
FIG. IB

PRECIOUS METAL RECOVERY SYSTEM

BACKGROUND OF THE INVENTION

1. Field of the Invention:

The present invention relates generally to a precious metal recovery system utilizing an amalgamation process which assures substantially complete recovery both of the precious metal sought and of the mercury needed for performing the process.

2. Description of the Prior Art:

Alloys of mercury with other metals, for example, silver, gold, cesium, zinc, or alkali metals have long been known. The knowledge that such alloys are readily formed was used by the Romans to extract precious metals such as silver and gold from silver and gold bearing ores when extraction was otherwise difficult or impossible to achieve. According to this process, known as amalgamation, the ore containing the particular metal sought is immersed in mercury or otherwise subjected to contact with mercury. The mercury surrounds the metal sought and forms an alloy with it known as an amalgam. Centuries after the Romans, the Spaniards extensively used the process in exploiting the metallic treasures of the New World.

In recent years, various attempts have been made to modernize and automate the amalgamation process. One such recent attempt is reflected in the Micron Gold Amalgamator Model 2000 invented by Alvin C. Hurd of Coachella, California and publicly known at least as early as February 1984. The apparatus thereby disclosed operates to force feed precious metal bearing ore, in a slurry mixture, through a bed of mercury to form an amalgam. The amalgam is withdrawn and the mercury subsequently separated out to yield of the precious metal. Unfortunately, that process and other known amalgamation processes have required handling of the mercury by personnel without proper safeguards either to the personnel or to the environment, even though it has long been known that mercury is a deadly poison and therefore possesses severe undesirable health and environmental characteristics.

SUMMARY OF THE INVENTION

It was with knowledge of the prior art as represented by the previously mentioned Hurd invention and of the hazards associated with the handling of mercury that the present invention has been conceived and reduced to practice. To this end, a precious metal recovery system utilizing an amalgamation process has been developed which results in substantially complete recovery both of the precious metal sought and of the mercury utilized in the process. As previously stated, mercury has severe undesirable health and environmental characteristics and the system of the invention assures its substantial containment. In the operation of the system, ore is classified and sorted out into a plurality of bins or holds containing ore having a substantially uniform particle size. The ore is then delivered, bin by bin, beginning with the smallest particle size, to apparatus which assures substantially complete amalgamation of all of the precious metal in the ore.

Thereafter, a resulting slurry of water and tails, that is, the ore substantially devoid of the precious metal, is first removed from the amalgamation apparatus and any residual mercury removed before its return to the environment. At the end of a period of operation of the amalgamation apparatus, the mercury and precious metal amalgam mixture together with any residual tails are drawn off and subjected to three separation operations. First, the mercury and precious metal amalgam mixture is separated from any residual tails. Next, the mercury is separated from the precious metal amalgam. Finally, the mercury is removed from the amalgam thereby resulting in a reasonably pure form of the precious metal.

The system thereby assures, after a minimal passage of time, recovery of substantially all of the precious metal present in the ore being processed. At the same time, substantially all of the mercury which is required for the amalgamation process is recovered, washed, and can be reused for subsequent operations. As a primary feature of the invention, the system does not require any handling of the mercury by operating personnel.

Thus, while a substantial economic benefit is achieved by reason of the invention, operating personnel are rendered safe from the hazards of working with mercury and the environment remains similarly unaffected.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate one of the embodiments of the invention and, together with the description, serve to explain the principles of the invention in general terms.

BRIEF DESCRIPTION OF THE DRAWINGS

FIGS. 1A and 1B, respectively, are left hand and right hand portions of a diagrammatic representation of a precious metal recovery system which embodies the present invention;

DETAILED DESCRIPTION OF THE PREFERRED EMBODIMENT

Figure 1A:
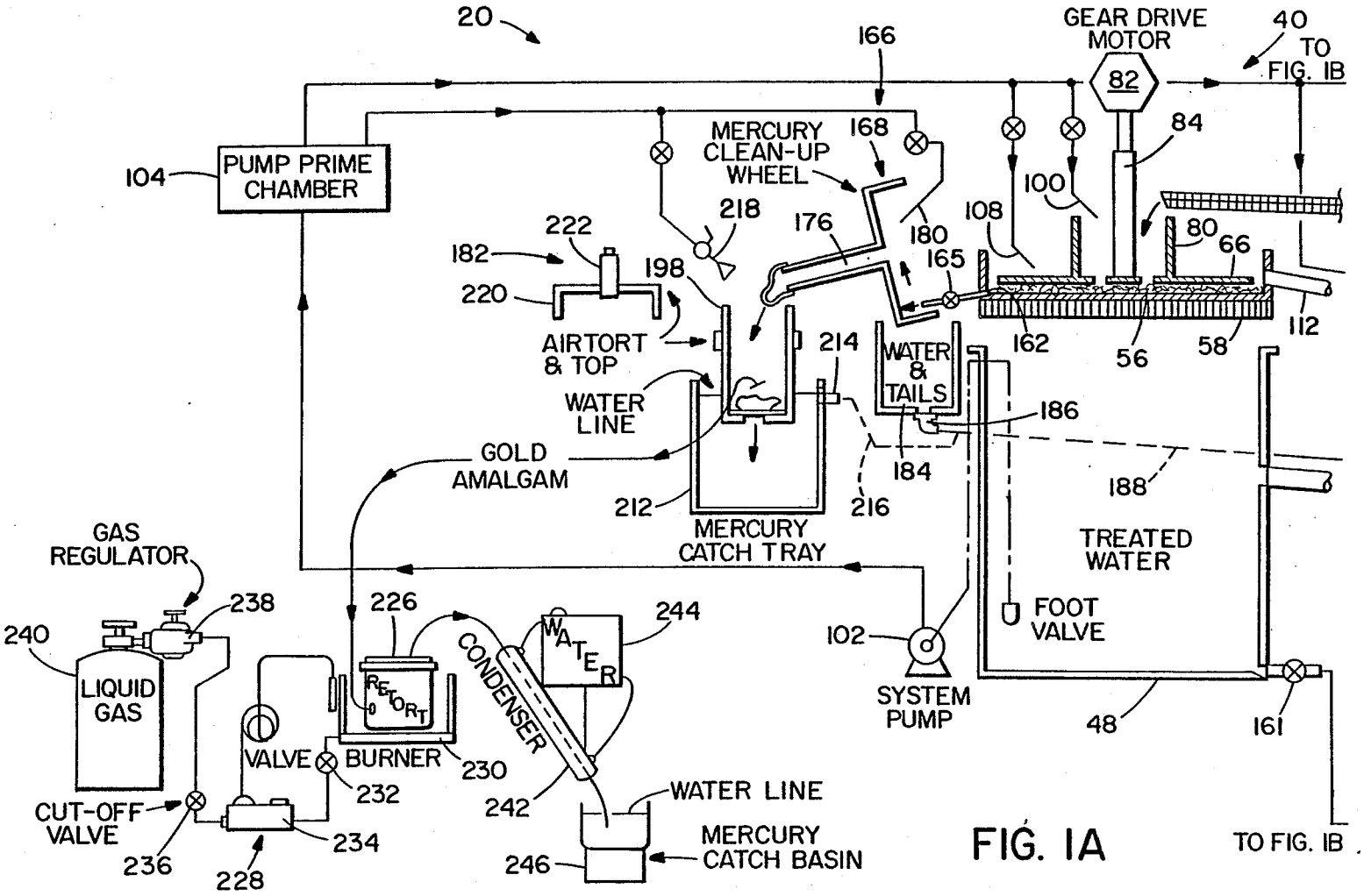
Figure 2:
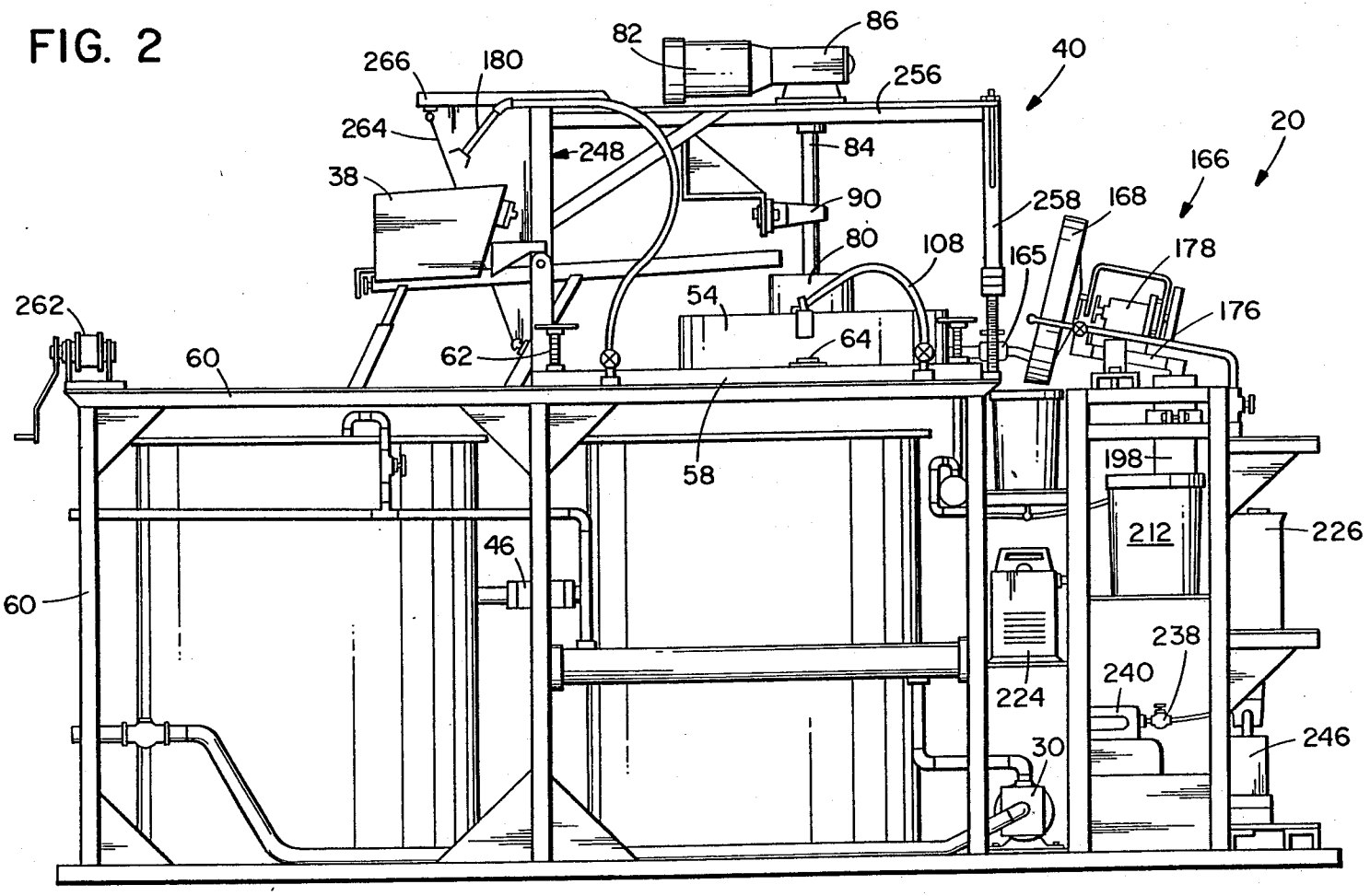
FIG. 2 is a side elevation view of one side of an actual construction of the precious metal recovery system.
Figure 3:
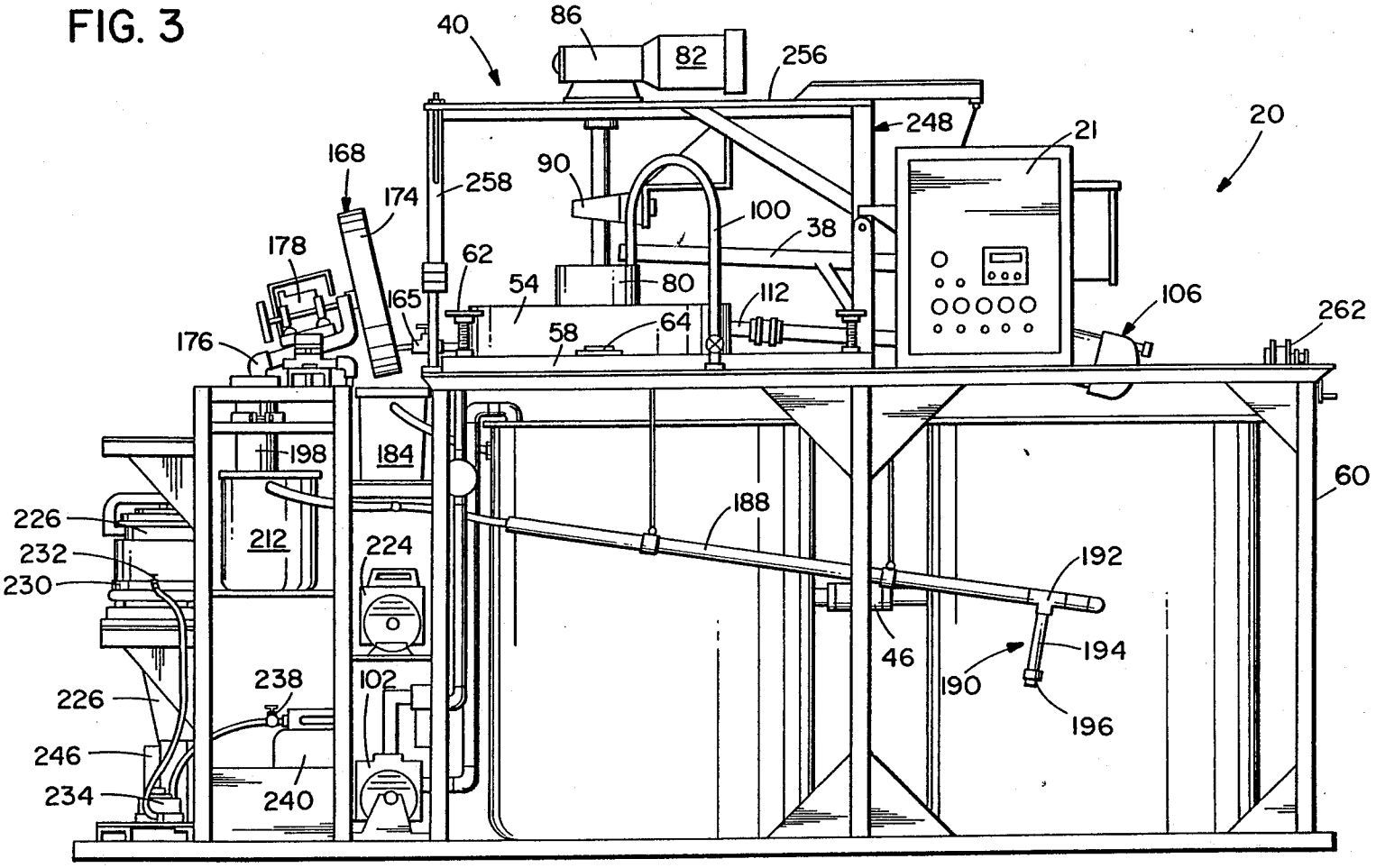
FIG. 3 is a side elevation view of another side of the precious metal recovery system.
Figure 5:
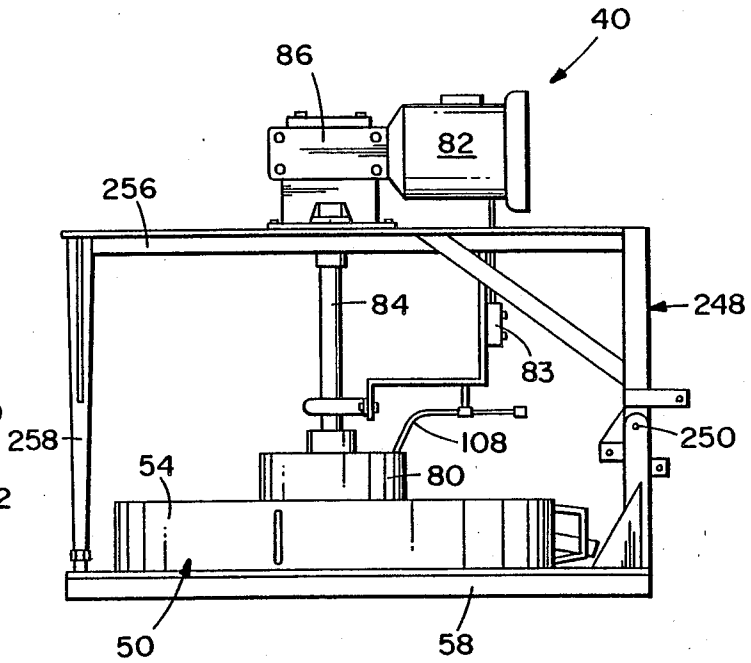
FIGS. 5, 6, and 7 are side elevation, end elevation, and top plan views, respectively, of amalgamation apparatus forming part of the precious metal recovery system of FIGS. 1–4.
Figure 4:
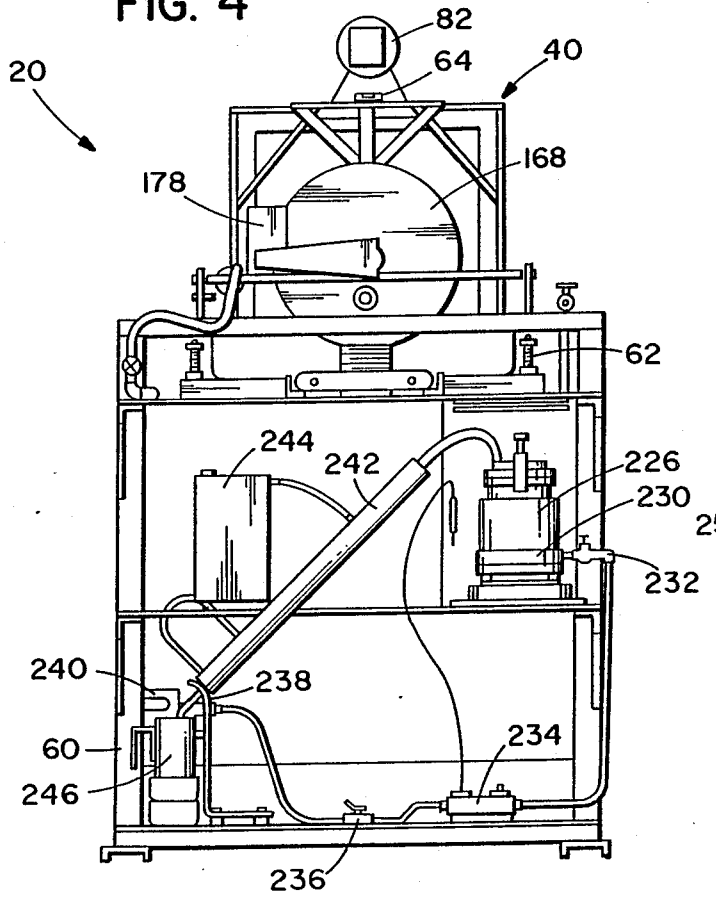
FIG. 4 is an end elevation view of the system illustrated in FIGS. 2 and 3.
Figure 7:
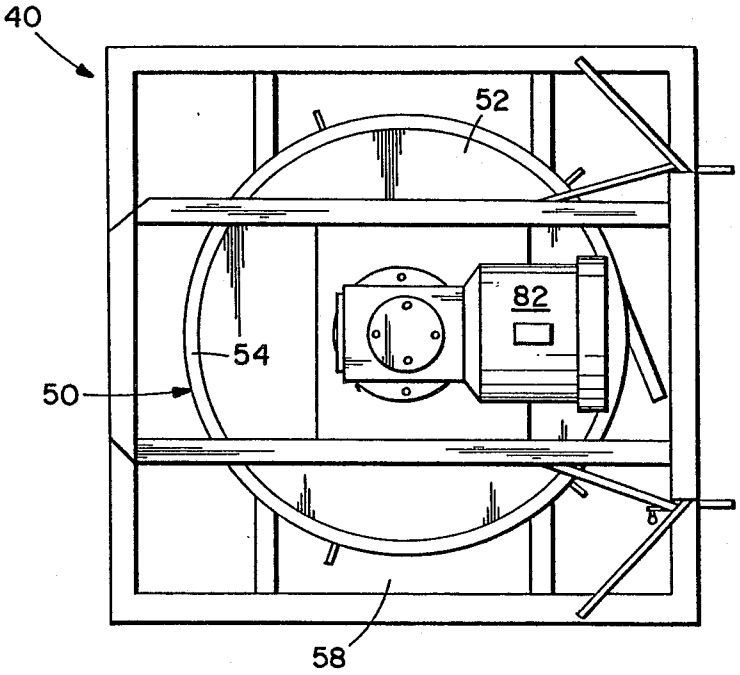
Figure 6:
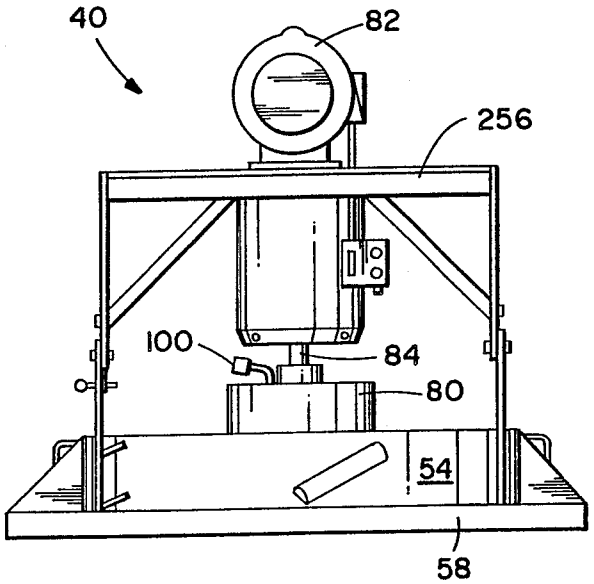

Turn now to the drawings and initially to FIGS. 1A and 1B which diagrammatically illustrates a precious metal recovery system embodying the invention and to FIGS. 2–4 which are illustrative of an actual construction of the system.

The system 20 may be land based or it may, just as readily, be sea based and, in that event, may be located on the deck of a ship or barge intended for operation on a body of water such as the ocean, a lake, or a river.

In any event, at the outset of operation of the system 20, all electrically powered devices being controlled from a suitable panel 21, ore is appropriately delivered to a powered classifier 22 (FIG. 1B) of known construction which, as illustrated, utilizes three screens of varying coarseness. For example, a screen 24 is depicted as being of ⅛ inch mesh size, a screen 26 is of 20-mesh size and a screen 28 is of 40-mesh size. To aid in the process, water is drawn from the body of water by means of a pump 30 and sprayed from a suitable nozzle 31 into the classifier 22. In a customary fashion, a pump prime chamber 32 is provided to assure that the pump 30 will not lose its prime. This is a particularly beneficial feature when operating in remote areas where a replacement for a burned out impeller would not be readily available.

As diagrammatically depicted in FIG. 1B, the coarsest ore material classified, that is the material which passes through the ⅛ inch mesh screen 24 is received in a bin or hold 34; the next coarsest ore material, namely that which passes through the 20-mesh screen 26 is received in a bin or hold 36; and that ore material which passes through the 40-mesh screen 28 is received in a bin or hold 37. The ore, thus classified, is then delivered to a screw feeder 38 for delivery, in turn, to an amalgamation unit 40 which will be described. A water spray nozzle 39 for wetting the ore in the screw feeder to aid the delivery operation is desirable.

It is important for optimum operation of the amalgamation unit 40 that the ore be delivered to it, bin by bin, beginning with material of the finest particle size and ending with material of the coarsest particle size. Therefore, the bin 37 must be emptied into the screw feeder 38 first, then the bin 36, and finally the bin 34. It will be appreciated that the classifier 22 may classify into many more, or fewer, particle sizes than illustrated, although three different sizes, as indicated, are desirable. The pump 30 may also be used, via a water line 42, to maintain a desired water level within a containment vessel 44 and, via a conduit coupling 46, a clear water vessel 48.

With particular attention now to FIGS. 5–11, the amalgamation unit 40 is seen to include a tub 50 having a bottom 52 and an upstanding sidewall 54 adapted to contain a charge of liquid mercury 56. The tub 50 is suitably mounted on a support platform 58 which, in turn, is adjustably mounted on a stationary base 60 which serves as supporting structure for the entire system 20. It is desirable that the upper surface of the charge of mercury 56 within the tub 50 be level, that is, substantially parallel to the bottom 52. For this purpose, a plurality of screw jacks 62 (FIGS. 2–4) having components, respectively, on the base 60 and on the support platform 58, permit adjustment of the position of the support platform relative to the base about mutually perpendicular axes. As an aid to leveling the tub 50 relative to a horizontal plane, a plurality of sight levels 64 are provided on the support platform 58 at diametrically opposed locations around the tub 50.

Figure 8:
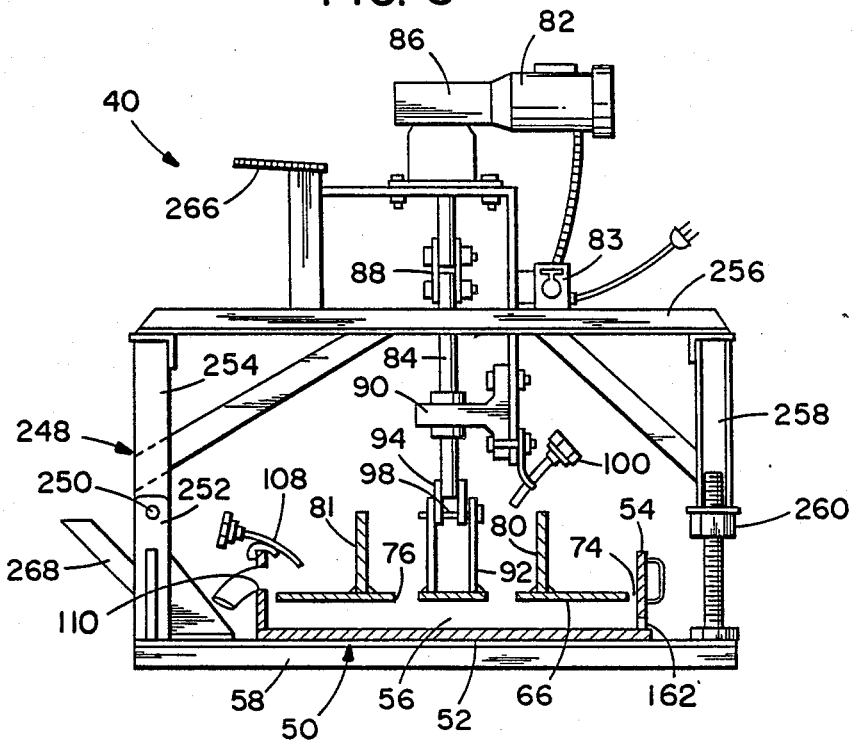
FIG. 8 is a side elevation view, similar to FIG. 5, certain parts being broken away and shown in section.
Figure 9:
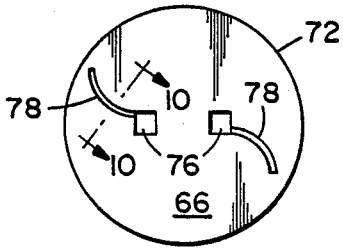
FIG. 9 is a bottom plan view of a component illustrated in FIG. 8.

A rotatable drive plate 66 is arranged to float on the surface of the charge of mercury 56 present in the tub 50. The drive plate 66 has an upper surface 68, a lower surface 70 (see FIG. 10), and an outer peripheral edge 72 proximate to but spaced from the sidewall 54 thereby defining an annular exit opening 74 (FIGS. 8 and 9). The lower surface 70 is thereby caused to lie in a plane substantially parallel to the bottom 52 of the tub 50 so long as the support platform 58 is horizontally disposed. The drive plate 66 has at least one ore receiving hole 76 extending through it and a generally radially, possibly arcuate, extending groove 78 is formed in the lower surface 70 associated with each such hole 76.

An annular wall 80 is integral with and upstanding from the upper surface 68 of the drive plate 66 and serves to define an ore feed chamber which is in communication with the ore receiving holes 76. The chamber defined by the annular wall 80 is adapted to receive the precious metal containing ore for an amalgamation operation which will be described.

For purposes of the amalgamation operation, the drive plate 66 is rotated about an axis generally perpendicular to the plane of the bottom 52 of the tub 50. Power may be supplied in any suitable manner as, for example, by an electric motor 82 which, upon actuation of a switch 83, drives an output shaft 84 through a reduction gear box 86 and an adjustable coupling 88. A pillow block 90 assures proper alignment of the output shaft 84 with a stub shaft 92 integral with and upstanding from a center of the drive plate 66. The stub shaft 92 is hollow so as to telescopically receive an extension 94 of the output shaft 84. A pair of diametrically opposed elongated longitudinally extending slots 96 are formed in the stub shaft 92 so as to receive therethrough a mounting pin 98 which also extends through diametrically positioned holes in the extension 94. This construction enables adjustment of the relative position between the drive plate 66 and the bottom 52 of the tub 50 according to the depth of the charge of mercury placed in the tub.

It will be appreciated that the size of the motor 82 and of the associated drive components would depend upon the size of the plate 66 and the particle size and volume of the ore being processed. In a typical operation, the rotational speed of the output shaft 84, and therefore of the plate 66, is in the range of 112–120 rpm. In operation, ore from an appropriate one of the bins 34, 36, 37 is delivered to the screw feeder 38 which, in turn, delivers the ore to the feed chamber defined by the annular wall 80. A nozzle 100 is positioned to direct a spray of water into the ore feed chamber so as to create a slurry of the ore and water so contained. Viewing FIG. 1A, a pump 102 may be employed to draw water from the vessel 48 for that purpose. It is noted that the pump 102 may employ a pump prime chamber 104 similar to the chamber 32 utilized in conjunction with the pump 30.

With rotation of the drive plate 66 and with the aid of gravity, the ore and water slurry flows through the hole 76 and is drawn along the groove 78 which communicates with each hole. Although rotation of the drive plate 66 clears a path through the charge of mercury 56 for passage of the ore and water slurry through the groove 78, the ore is dragged across the upper surface of the mercury and is thereby caused to come into intimate contact with the mercury. The mercury surrounds the precious metal within the ore with which it comes in contact and forms an amalgam which descends into the body of the liquid mercury. The amalgamation operation is further enhanced by reason of the fact that the grooves 78 do not extend all the way to the outer peripheral edge 72. This assures even more intimate contact between the ore and the mercury in a region at which the speed of a point on the plate 66 is greatest with respect to the mercury 56. By the time the ore and slurry mixture reaches the annular exit opening 74, it is substantially devoid of the precious metal. The ore thus substantially devoid of the precious metal is commonly termed "tails". This resulting tails and water slurry is then drawn onto the upper surface 68 of the drive plate 66 and is temporarily confined to a receiving chamber defined by the annular wall 80, the upper surface 68, and the side wall 54 of the tub 50.

An important feature of the invention resides in the fact that all of the components of the amalgamation unit 40 which has surfaces subject to contact by the mercury are composed of a material which is chemically inert relative to the mercury. Such a preferred material is polyvinyl chloride, commonly known as "PVC". Stainless steel or structural metals coated with fiberglass may also be used with success. For purposes of the amalgamation unit 40, those components which would preferably be composed of PVC would at least include the tub 50 and the drive plate 66, although it would be desirable for all of the components integral with the drive plate, namely, the annular wall 80 and the stub shaft 92 to be of the same material. Indeed, it might even be desirable for the drive plate 66, the annular wall 80, and the stub shaft 92 to be of a one piece molded construction.

Continually during the amalgamating operation, the tails and water slurry is removed from the receiving chamber to a mercury trap device 106 as seen in FIGS. 1B, and 11–13. For this purpose, a nozzle 108, similar to nozzle 100, is positioned to direct a spray of water into the receiving chamber so as to maintain a slurry of the tails and water which are contained therein. As with the nozzle 100, the pump 102 may be employed to draw water from the vessel 48 for that purpose. By gravity, the tails and water slurry flows through a drain 110 in the sidewall 54 (see FIG. 8) then through a conduit 112 which leads into the interior of the trap device 106. The trap 106 is at a lower elevation than the tub 50 and the rotation of the drive plate 66 assures that a constant supply of the tails and water slurry within the receiving chamber will be caused to flow through the drain 110 into the conduit 112 and eventually into the trap device 106. The trap device 106 serves to separate out any residual mercury present in the tails and water slurry in the receiving chamber and to deposit such mercury in a catch basin 114 suitably suspended as by hangers 116 from a wall of the containment vessel 44.

The trap device 106 is enclosed and includes an outer elongated tubular member 118 having an inclined longitudinal axis (FIGS. 1B and 11) and extending between an upper end surface 120 and a lower end surface 122. In actual fact, the upper end surface 120 is a part of an upper cap member 124 which includes a rim 126 which extends outwardly from the end surface 120 for fitting reception on an upper end of the outer tubular member 118. In a similar fashion, a lower cap member 128 includes a rim 130 which extends outwardly from the end surface 122 for fitting reception on a lower end of the outer tubular member 118. A drain port 132 is formed in the rim 130 and a nipple 134 is fixed to the cap member 128, being fittingly received in, or otherwise fixed to, the drain port 132 so as to communicate with the interior of the outer tubular member 118. An inner tubular member 136 of substantially smaller diameter is received within the outer tubular member 118 and extends from the upper end surface 120 to and through the lower end surface 122 and continues a substantial distance beyond the end surface 122. An actual fact, the inner tubular member 136 extends, in close fitting relationship, through an opening 138 in the cap member 128.

Figure 13A:
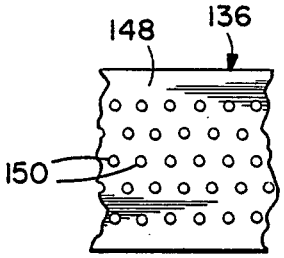
FIG. 13A is a detail bottom plan view illustrating an alternative sieve construction from that illustrated in FIGS. 12 and 13.
Figure 10:
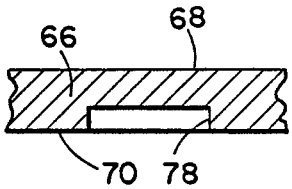
FIG. 10 is a cross section view taken generally along line 10—10 in FIG. 9.
Figure 11:
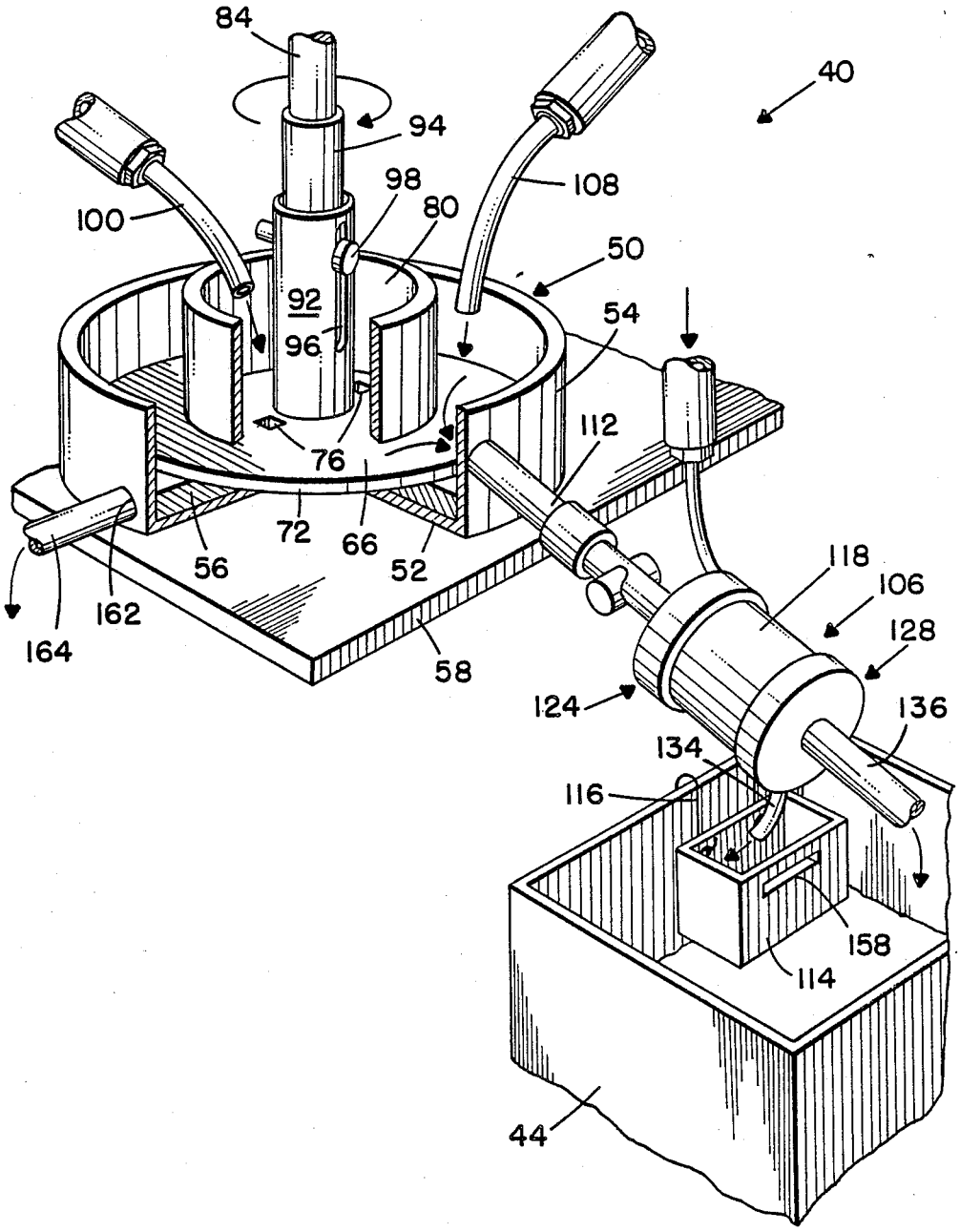
FIG. 11 is a perspective view illustrating the amalgamation apparatus of FIGS. 5–8, a primary mercury trap mechanism utilized therewith, and other components of the invention.
Figure 12:
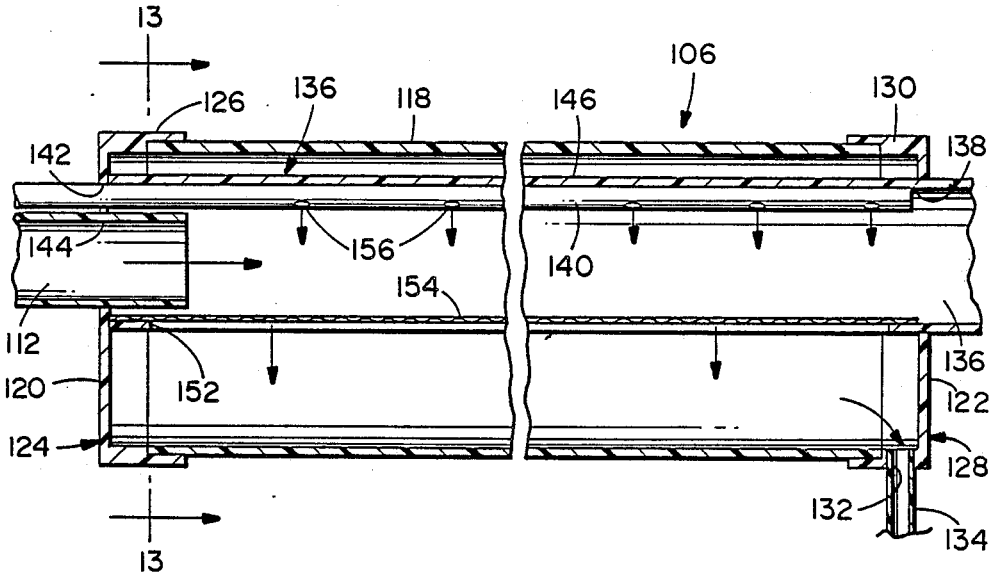
FIG. 12 is a longitudinal cross section view of the primary mercury trap mechanism illustrated in FIGS. 1A, 1B and 11.
Figure 13:
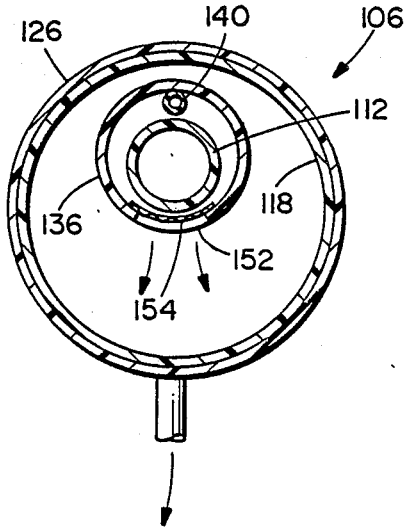
FIG. 13 is a cross section view taken generally along line 13—13 in FIG. 12.

An elongated spray bar 140 having a longitudinal axis substantially parallel to that of the outer tubular member 118 extends through an opening 142 in an upper end surface 120 of the upper cap member 124. In a similar manner, the outlet conduit 112 extends, generally in fitting relationship, through an opening 144 in the upper end surface 120 which is proximate to the opening 142. The inner tubular member 136 has an upper side 146 which is supported by the spray bar 140. A lower side 148 of the inner tubular member 136 may be provided with a plurality of sieve holes 150 as illustrated in FIG. 13A. However, according to a preferred construction, the lower side 148 of the inner tubular member 136 has an elongated opening 152 therein (FIGS. 12 and 13) with a perforated stainless steel sheet 154 overlying the elongated opening and bonded by means of epoxy or other suitable adhesive to the inner tubular member. In place of perforated stainless steel sheet 154, a stainless steel screen having suitably sized openings may similarly be employed.

As with the amalgamation unit 40, it may be desirable for all components of the trap device 106, except for the stainless steel sheet 154, to be composed of a material, preferably PVC, which is chemically inert relative to mercury.

In the course of the operation of the amalgamation unit 40, the slurry of tails and water is directed through the outlet conduit 112 into the mercury trap unit 106. From the outlet conduit 112, the slurry flows into the inner tubular member 136 whereupon it is sprayed by water issuing from a plurality of downwardly directed outlet ports 156 provided in the spray bar 140. The additional spray provided by the spray bar serves to break up the tails, adds to the fluidity of the slurry to keep the tails moving, and assures that the slurry will flow in contact with the perforated sheet 154. The size of the openings in the perforated sheet is so determined as to permit flow of water and mercury into that portion of the outer tubular member 118 beneath the inner tubular member 136 but are not receptive to the passage of tails which continue to flow through the tubular member 136 and eventually into the containment vessel 44. The water and mercury present in the lower portion of the tubular member 118 exit through the nipple 134 into the catch basin 114. While the mercury flows to the bottom of the catch basin, the water in the catch basin only rises to the level of an overflow port 158 and from there flows into the containment vessel 44. It is desirable for water to be in the catch basin 114 overlying the mercury to prevent fumes which naturally rise from the mercury because of its toxic nature.

While it is desirable for the level of the water in the containment vessel 44 to be higher than the conduit coupling 46 connecting the vessels 44 and 48, it would not be desirable for the vessel 44 to overflow and to prevent this occurrence, a drain valve 160 at its bottom may be opened periodically to return the water and tails to the body of water whence they originally came. In a similar fashion, a drain valve 161 at the bottom of the vessel 48 may be selectively opened to adjust the level of the water therein.

Figure 14:
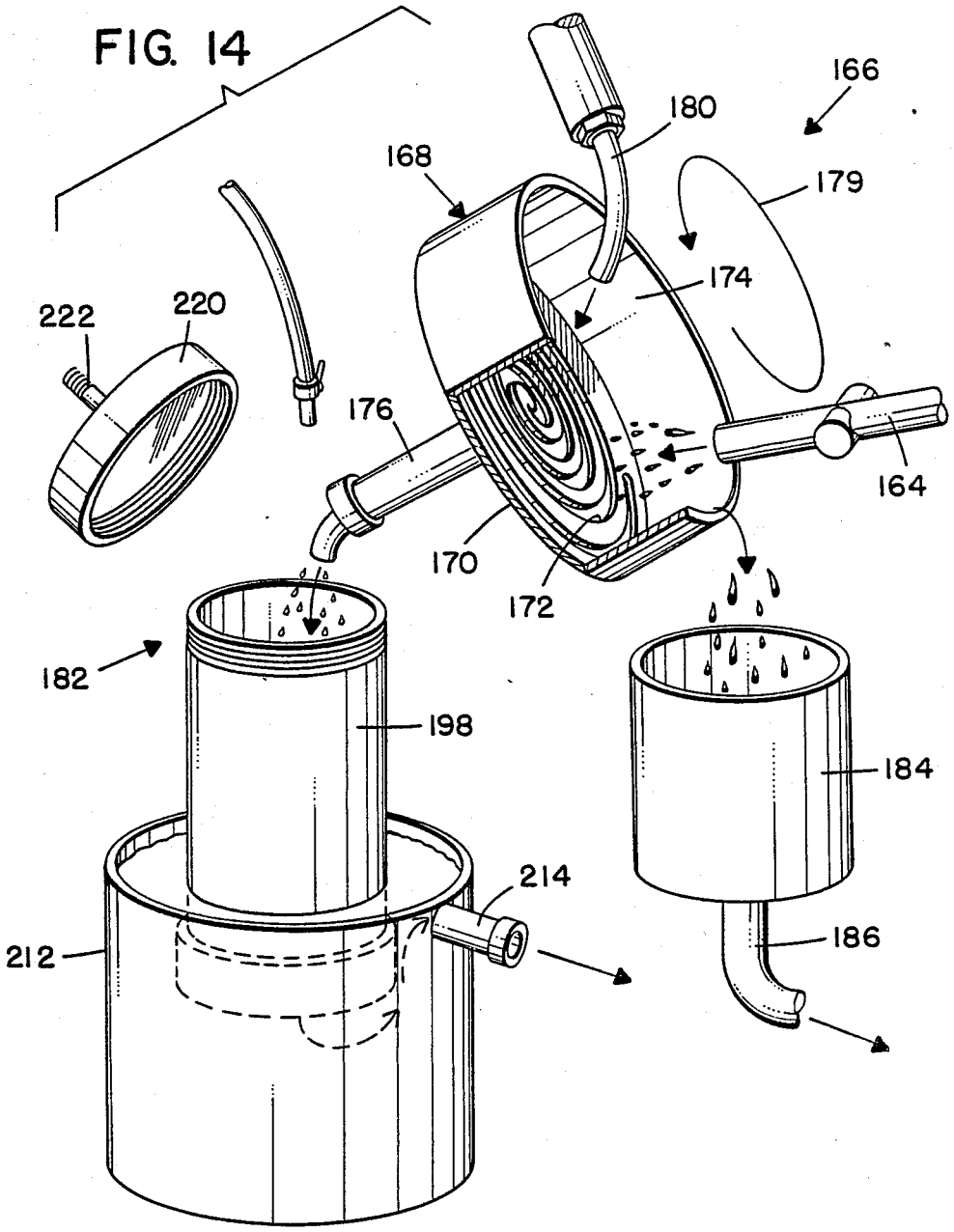
FIG. 14 is a perspective view of components for receiving and operating upon the mercury and mercury amalgam mixture received from the amalgamation apparatus at the conclusion of an operation thereof.

At the conclusion of a period of operation of the amalgamation unit 40, the charge of mercury 56 contained within the tub 50 envelops, in amalgamated form, the precious metal which was recovered from the ore originally present in the ore feed chamber. Thereupon, in order to recover both the precious metal sought and the mercury used in the process, the tub 50 is drained of its contents by way of a drain hole 162 and a drain conduit 164 upon operation of a suitable stainless steel valve 165 for delivery thereof to a mercury recovery unit 166. As seen particularly well in FIG. 14, the mercury recovery unit 166 includes a receptacle 168 for receiving and temporarily holding a mixture of the liquid material received from the tub 50. That mixture includes liquid mercury, precious metal amalgam, water, and tails. The latter two commodities represent only a small proportion of the volume of the liquid being transferred, but are present nevertheless. The receptacle 168 includes a clean-up wheel 170 in the form of a flat circular disk having a spiral groove 172 in its surface facing into its interior. An outwardly extending peripheral wall 174 is integral with and extends outwardly from the clean-up wheel 170 and defines an opening into the receptacle. Additionally, the receptacle includes an integral discharge conduit 176 which extends from an exterior side of the clean-up wheel 170, that is, a side opposite that containing the spiral groove 172. As seen in FIGS. 1A and 14, the discharge conduit 176 communicates with the interior of the receptacle 168, most particularly, at the end of the spiral groove 172 at the center of the clean-up wheel 170.

As the liquid having the constituents as previously defined issues from the drain conduit 164, it is received by the receptacle 168. The receptacle 168 is canted at an angle of approximately 12°–15°, although that particular value is not critical, and is rotatable about its axis which extends through the center or innermost terminus of the spiral groove 172 and includes the axis of the discharge conduit 176. In operation, the receptacle is rotated by means of a wheel drive motor 178 (FIGS. 2 and 3) in the direction of an arrow 179. A typical speed of rotation for the receptacle 168 is 40 rpm although that value is not critical to the invention. By reason of its weight, the mercury and mercury amalgam present in the liquid finds its way into the groove 172 as the outermost part of the groove passes the lowermost portion of its travel. Simultaneously, a wash spray nozzle 180 which, similar to nozzles 39, 100, 108, and spray bar 140 receive water from pump 102, directs a washing spray in the direction of the groove 172 and serves to clean the mercury and amalgam therein of any unwanted ore particles and slimes which may be present thereon.

The cleansed mercury and amalgam leave the innermost terminus of the spiral groove 172 and passes through the discharge conduit 176 into an air tort 182 positioned to receive the flow of liquid from the center of the receptacle 168.

As seen particularly well in FIGS. 1A and 14, a water and tails basin 184 is positioned beneath the receptacle 168 and serves to receive liquid therefrom as it overflows the outermost rim of the peripheral wall 174. For the most part, the basin 184 serves to receive the slurry of tails and water which are present in the receptacle, although some residual mercury may also be present in the liquid flowing from the receptacle and into the basin 184. An outlet 186 is provided in the bottom of the basin 184 for communication with an elongated drain pipe 188 (FIGS. 1A, 1B, and 3) which, at its terminal end, communicates with the interior of the containment vessel 44 for return of the tails and water thereto.

An auxiliary mercury trap unit 190 (FIGS. 1B and 3) is mounted as an integral part of the drain pipe 188 for removal of any residual mercury which may be flowing with the water and tails from the basin 184 toward the vessel 44. In effect, the trap unit 190 is a T-fitting which includes a cross line 192 fixed to and aligned for communication with the drain pipe 188 and an integral downwardly extending trap line 194 in communication with the cross line and positioned to receive the heavier mercury as it flows through the drain pipe. The trap line 194 terminates at a threaded open end to which a threaded terminal fitting 196 is threadedly engaged. The terminal fitting 196 is normally threaded tight for closure of the trap line 194, but is selectively removable for periodically extracting any accumulations of mercury which occur in the trap line.

As with the amalgamation unit 40 and the trap device 106, it may be desirable for all of the components of the mercury recovery unit 166 and of the auxiliary trap unit 190 which come into intimate contact with mercury, with the exception of the filter assembly 204, to be composed of a material, preferably PVC, which is chemically inert relative to mercury.

Figure 15:
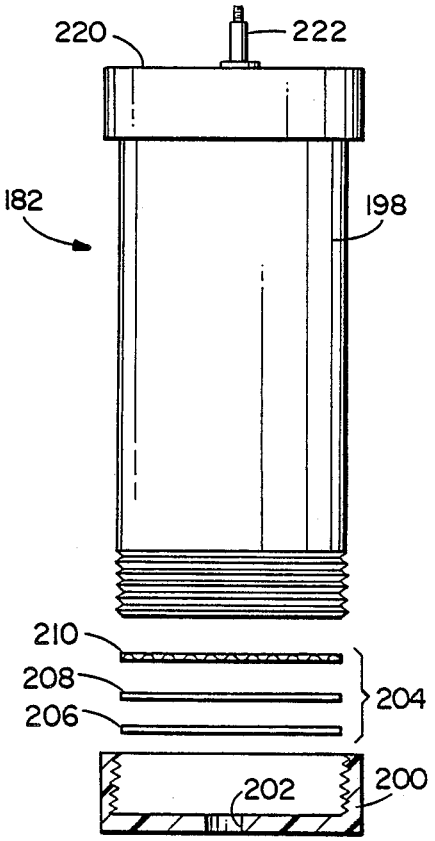
FIG. 15 is a side elevation view, partially exploded illustrating one of the components illustrated in FIG. 14.

Turn now particularly to FIGS. 1A, 14, and 15 for a complete description of the air tort 182. As illustrated, the air tort includes a central cylindrical container 198 which has a substantially vertically disposed longitudinal axis and is externally threaded at both its upper and lower ends. A lower threaded closure member 200 (FIG. 15) is provided with a central aperture 202 and when tightened onto the lower end of the container 198 secures in position a filter assembly 204 which is employed for collection thereon of the precious metal amalgam present in the liquid as it issues from the discharge conduit 176. The filter assembly 204 includes a perforated stainless steel disk 206 which is similar in diameter to the outer diameter of the container 198. When the closure member 200 is tightened onto the container 198, the perforated disk 206 overlies and is contiguous with the aperture 202. A chamois disk 208 is similar in diameter to the perforated disk 206 and contiguous thereto. Next, in turn, is a disk shaped stainless steel screen 210 which has a similar diameter to the disks 206 and 208 and is positioned contiguous to the chamois disk 208. Thus, the relatively limp chamois disk is sandwiched between the perforated disk 206 and the screen 210 to provide it with a measure of strength sufficient for supporting the amalgam thereon.

A mercury catch tray 212 is positioned beneath the air tort 182 and is filled with water to a level defined by an overflow port 214. In turn, by way of a connector pipe 216, the overflow port 214 is in communication with the drain pipe 188 and therethrough with the containment vessel 44. However, not only is the mercury catch tray 212 positioned beneath the air tort 182, but the latter unit is actually immersed in the water within the catch tray. When all of the mercury and amalgam present in the receptacle 168 has been delivered to the air tort through its open upper end, a hand operated spray nozzle 218, which also receives water under pressure from the pump 102, is operated to wash down the inside walls of the container 198 to cleanse them of any residue and assure that all solid constituents are located at the bottom thereof resting on the filter assembly 204.

Thereupon, an upper threaded closure member 220 is screwed onto the upper end of the container 198 and is tightened down thereon. The closure member 220 is provided with a conventional valve stem 222 which is threadedly engaged with a tapped aperture formed therein. Thus, with the closure member 220 tightened onto the central container 198, air pressure, for example, approximately 30 psi, is applied through the valve stem to the interior of the container 198 from a suitable air compressor 224. As compressed air is applied to the air tort 182, the mercury is forced through the chamois disk 208 into the mercury catch tray 212 leaving only the precious metal amalgam in the air tort resting upon the filter assembly 204. As previously mentioned with respect to the water and tails basin 184, the water in the mercury catch tray prevents the undesirable emission of vapors from the mercury present therein. At the end of an amalgamating operation, all of the water within the mercury catch tray can be drained off leaving the washed mercury therein available for reuse in another operation.

After an appropriate time, the application of compressed air to the air tort 182 is terminated and, by operation of the valve stem 222, the interior of the air tort is returned to ambient pressure. The closure member 220 is removed from the container 198 and the precious metal amalgam which is retained by the filter assembly 204 is placed in a suitable retort 226 of a precious metal recovery station 228.

In a known manner, the retort 226 is heated as by a gas fired burner 230 which is controlled by means of a valve 232, a temperature control and safety valve 234, a hand or cut-off valve 236, and a pressure regulator 238. Gas is supplied to the burner 230 by means of a propane gas tank 240. Upon heating the retort 226, the remaining mercury in the precious metal amalgam is vaporized from the precious metal sponge and travels through a condensing tube 242. As they travel through the condensing tube, the mercury vapors are cooled by means of a water jacket 244 which encompass the condensing tube. Upon cooling, the mercury vapor returns to the normal liquid state and exits the condensing tube into a mercury catch basin 246. Again, it is desirable for water to overlie the mercury within the catch basin 246 in order to prevent mercury vapor emissions. At this stage of the operation, the mercury in the catch basin 246 is available for reuse. The precious metal is removed from the retort 226 and may be further refined or sold as is.

After an amalgamating operation is completed and it is desired to clean the unit 40, a construction which is about to be described can prove to be useful. With particular attention now to FIG. 8, it is seen that a pair of spaced apart legs 248 are pivoted as at 250 to thereby provide a lower portion 252 fixed to the support platform 58 and an upper portion 254 which moves together with an integral upper frame 256 in a counterclockwise direction to open and in a reverse manner to close. A leg 258 is provided at an opposite side of the frame 256 relative to the legs 248. While it is fixed to the frame 256, by reason of nuts 260 thereon, it is adjustable in length to thereby adjust the relative position of the frame 256 and all of the components thereon relative to the support platform 58. A particular purpose for the adjustible leg 258 is the positioning of the shaft 84 relative to the drive plate 66.

Hence, when it is desired to clean the amalgamation unit 40, the pin 98 is removed from the stubshaft 92 and from the extension 94. Thereupon, by operation of a crank 262 mounted on the base 60, and a suitable cable 264 (FIG. 2), a handle 266 fixed to the upper frame 256 to which the cable is attached is drawn to the left (FIGS. 2 and 8). This operation causes the frame 256 to be tilted about the pivots 250 until the upper portions 254 of the legs 248 engage and rest on associated back stops 268 fixed to the support platform 58. With the frame 256 and all of the components which it supports thereby removed from close proximity to the tub 50, the unit can be cleaned with relative ease, following which a reverse procedure will quickly return it to operable status.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A precious metal recovery system comprising:

a base;

a tub having a bottom and an upstanding sidewall adapted to contain liquid mercury;

a support platform for said tub mounted on said base;

leveling means for adjusting the position of said support platform on said base about mutually perpendicular axes;

a rotatable drive plate floatable on the mercury within said tub and having an upper surface, a lower surface, and an outer peripheral edge proximate to but spaced from said sidewall to thereby define an annular exit opening, said lower surface lying in a plane substantially parallel to said bottom of said tub, said drive plate having at least one ore receiving hole extending therethrough and a generally radially extending groove in said lower surface associated with each such hole;

an annular wall integral with and upstanding from said upper surface to define an ore feed chamber in communication with each ore receiving hole, said ore feed chamber adapted to receive therein precious metal containing ore;

first nozzle means for directing a spray of water into said ore feed chamber to thereby create a slurry of the core and the water;

drive means for rotating said drive plate about an axis substantially perpendicular to said lower surface, said drive means including means for accommodating different depths of mercury within said tub while maintaining said lower surface substantially parallel to said bottom; and a receiving chamber defined by said annular wall, said upper surface of said drive plate, and said sidewall of said tub;

whereby, with rotation of said drive plate and with the aid of gravity, the ore and water slurry flows through each ore receiving hole and is drawn along the groove and dragged across the upper surface of the mercury, resulting in amalgamation of the precious metal, the resulting tails and water slurry, substantially devoid of the precious metal, being advanced through the annular exit opening between said outer peripheral edge and said sidewall and onto said upper surface in said receiving chamber.

2. A precious metal recovery system as set forth in claim 1 wherein said drive means includes:

an upper shaft having a lower end and a diametrically extending bore therethrough adjacent said lower end;

a lower hollow stub shaft telescopically received on said upper shaft and having a pair of longitudinally extending slots at diametrically opposed locations; and a pin extending through the slots in said stub shaft and through the bore in said upper shaft to enable adjustment of the relative position between said drive plate and said bottom of said tub in accordance with the depth of mercury in said tub.

3. A precious metal recovery system as set forth in claim 1 wherein all of said components having surfaces subject to contact by the mercury are composed of a material which is chemically inert relative to mercury.

4. A precious metal recovery system as set forth in claim 1 wherein all of said components having surfaces subject to contact by the mercury are composed of PVC.

5. A precious metal recovery system as set forth in claim 1 wherein said leveling means includes:

at least a pair of screw jacks having components respectively on said base and on said support platform for adjusting the position of said support platform on said base about mutually perpendicular axes.

6. A precious metal recovery system as set forth in claim 1 including:

sight means for indicating the attitude of said tub relative to a horizontal plane.

7. A precious metal recovery system as set forth in claim 1 including:

classification means for receiving ore and separating the ore according to a plurality of uniform particle sizes; and feeder means for delivering ore of a uniform particle size to said feed chamber.

8. A precious metal recovery system as set forth in claim 1 including:

means for drawing off from the bottom of said tub the mercury and precious metal amalgam mixture and any residual tails therein;

first separation means for separating the mercury and precious metal amalgam mixture from the residual tails;

second separation means for separating the mercury from the precious metal amalgam; and third separation means for separating the precious metal in the amalgam from the mercury.

9. A precious metal recovery system comprising:

a tub having a bottom and an upstanding sidewall adapted to contain liquid mercury;

a rotatable drive plate floatable on the mercury within said tub and having an upper surface, a lower surface, and an outer peripheral edge proximate to but spaced from said sidewall to thereby define an annular exit opening, said lower surface lying in a plane substantially parallel to said bottom of said tub, said drive plate having at least one ore receiving hole extending therethrough and a generally radially extending groove in said lower surface associated with each such hole;

an annular wall integral with and upstanding from said upper surface to define an ore feed chamber in communication with each ore receiving hole, said ore feed chamber adapted to receive therein precious metal containing ore;

first nozzle means for directing a spray of water into said ore feed chamber to thereby create a slurry of the ore and the water;

drive means for rotating said drive plate about an axis substantially perpendicular to said lower surface, said driving means including means for accommodating different depths of mercury within said tub while maintaining said lower surface substantially parallel to said bottom;

a receiving chamber defined by said annular wall, said upper surface of said drive plate, and said sidewall of said tub;

whereby, with rotation of said drive plate and with the aid of gravity, the ore and water slurry flows through each ore receiving hole and is drawn along the groove and dragged across the upper surface of the mercury, resulting in amalgamation of the precious metal, the resulting tails and water slurry, substantially devoid of the precious metal, being advanced through the annular exit opening between said outer peripheral edge and said sidewall and onto said upper surface in said receiving chamber;

a containment vessel;

a catch basin for receiving recovered mercury; and mercury trap means in communication with said receiving chamber positioned to receive the tails and water slurry therefrom for separating out any remaining mercury present in the tails and water slurry and depositing such recovered mercury in said catch basin and directing flow of the cleansed tails and water slurry into said containment vessel.

10. A precious metal recovery system as set forth in claim 9 including:

second nozzle means for directing a spray of water into said receiving chamber for increasing the fluidity of the tails and water slurry therein.

11. A precious metal recovery system as set forth in claim 9 wherein said containment vessel and said catch basin are both at an elevation lower than that of said receiving chamber; and wherein said mercury trap means includes:

an enclosed outer elongated housing having an inclined longitudinal axis, extending between an upper end surface and a lower end surface;

an inner elongated tubular member within said outer housing having a longitudinal axis substantially parallel to the longitudinal axis of said outer housing, said inner tubular member having an upper side and a lower side and extending between an open upper end and an open lower end, said lower side including sieve means for passage of water and mercury while restraining passage of tails; and drain means at a lowermost region of said outer housing for directing flow of the recovered mercury into said catch basin.

12. A precious metal recovery system as set forth in claim 11 including:

an elongated spray bar having an axis substantially parallel to that of said outer housing and extending substantially through said inner tubular member along said upper side thereof for directing a spray of water toward said sieve means.

13. A precious metal recovery system as set forth in claim 11 wherein said outer housing includes:

an outer tubular member having open upper and lower ends;

an upper cap member including said upper end surface and an outwardly extending rim for fitting reception on said upper end of said outer tubular member, said cap member having first and second openings therein; and a lower cap member including said lower end surface having a third opening therethrough and an outwardly extending rim for fitting reception on said lower end of said outer tubular member;

said drain means including:

a drain port in a lowermost region of said rim; and a nipple fixed to said lower cap member at the drain port and extending away from said rim.

14. A precious metal recovery system as set forth in claim 13 including an outlet conduit extending from said sidewall of said tub through the first opening in said upper cap member and into the interior of said inner tubular member to direct flow of the tails and water slurry into said inner tubular member;

said inner tubular member extending through the third opening in said lower cap member and terminating at a free end spaced from said lower cap member;

an elongated spray bar having an axis substantially parallel to that of said outer tubular member extending through the second opening in said upper cap member, through said inner tubular member and along said upper side thereof for directing a spray of water toward said sieve means.

15. A precious metal recovery system as set forth in claim 11 wherein said sieve means includes an elongated opening in said lower side of said inner tubular member and a perforated stainless steel sheet overlying the elongated opening and bonded to said inner tubular member.

16. A precious metal recovery system as set forth in claim 11 wherein said sieve means includes an elongated opening in said lower side of said inner tubular member and a stainless steel screen overlying the elongated opening and bonded to said inner tubular member.

17. A precious metal recovery system as set forth in claim 11 wherein said sieve means includes a plurality of openings formed in said lower side of said inner tubular member.

18. A precious metal recovery system as set forth in claim 17 including:

a containment vessel for receiving water and tails which flow from said free end of said inner tubular member.

19. Mercury recovery apparatus for use with a precious metal recovery system comprising:

a receptacle for receiving and temporarily holding a mixture of liquid mercury, precious metal amalgam, water, and tails, said receptacle including a clean-up wheel being an imperforate flat circular disk having an integrally formed outwardly extending peripheral wall, said disk having a surface facing outwardly into the interior of said receptacle with a spiral groove thereon, said receptacle being rotatable about an inclined axis;

an air tort positioned at an elevation lower than that of said receptacle for receiving washed mercury and precious metal amalgam from said receptacle for separating the mercury from the precious metal amalgam;

a discharge conduit fixed to said clean-up wheel and communicating with a discharge opening extending through said wheel at an innermost terminus of said spiral groove;

a spray nozzle for directing a spray of wash water at said clean-up wheel to wash the mercury and precious metal amalgam thereon;

rotation of said receptacle causing the mercury and the precious metal amalgam substantially devoid of tails to flow through said spiral groove to the discharge opening, then through said discharge conduit into said air tort.

20. Mercury recovery apparatus as set forth in claim 19 including:

a water and tails basin positioned beneath said rotatable receptacle for receiving water and tails and any residual mercury which overflow said peripheral wall.

21. Mercury recovery apparatus as set forth in claim 20 wherein said water and tails basin has a discharge opening in its bottom; and including:

a containment vessel for receiving water and tails from said water and tails basin; and a drain pipe extending between the discharge opening in said water and tails basin and said containment vessel enabling flow therethrough of the water and tails from said basin to said containment vessel.

22. Mercury recovery apparatus as set forth in claim 21 including auxiliary mercury trap means in said drain pipe intermediate said water and tails basin and said containment vessel for removal of any residual mercury flowing with the water and tails from said water and tails basin toward said containment vessel.

23. Mercury recovery apparatus as set forth in claim 19 wherein said air tort includes:

a central cylindrical container having a substantially vertically disposed longitudinal axis and being externally threaded at both its upper and lower ends;

a lower threaded closure member threadedly engaged with said lower end of said container and having an aperture extending therethrough; and filter means for collection thereon of the precious metal amalgam present in the liquid received from said rotatable receptacle.

24. Mercury recovery apparatus as set forth in claim 23 including:

an upper threaded closure member threadedly engageable with said upper end of said container and having a tapped aperture extending therethrough;

a valve stem threadedly engaged with the tapped aperture in said upper closure member; and a mercury catch tray positioned beneath said air tort;

whereby, when air pressure is applied to the interior of said container via said valve stem, mercury, water and any residual tails are caused to pass through said filter means and through the aperture in said lower closure member into said catch tray, leaving behind the precious metal amalgam on said filter means.

25. Mercury recovery apparatus as set forth in claim 24 wherein said mercury catch tray has a water and tails overflow port to thereby define a maximum level which can be achieved therein; and including:

a containment vessel for receiving overflow water and residual tails from said mercury catch tray; and a drain pipe extending between the overflow port in said mercury catch tray and said containment vessel enabling flow therethrough of the water and tails from said catch tray to said containment vessel.

26. Mercury recovery apparatus as set forth in claim 25 wherein said auxiliary trap means is a T-fitting including:

a cross line fixed to and aligned for communication with said drain pipe;

a downwardly extending trap line in communication with said cross line and positioned to receive the heavier mercury as it flows through said drain pipe, said trap line terminating at a threaded open end; and a threaded terminal fitting for threaded engagement with said open end normally for closure thereof but selectively removable in order to remove any accumulations of mercury in said trap line.

27. Mercury recovery apparatus as set forth in claim 25 including auxiliary mercury trap means in said drain pipe intermediate said mercury catch tray and said containment vessel for removal of any residual mercury flowing with the water and tails from said mercury catch tray toward said containment vessel.

28. Mercury recovery apparatus as set forth in claim 27 wherein said auxiliary trap means is a T-fitting including:

a cross line fixed to and aligned for communication with said drain pipe;

a downwardly extending trap line in communication with said cross line and positioned to receive the heavier mercury as it flows through said drain pipe, said trap line terminating at a threaded open end; and a threaded terminal fitting for threaded engagement with said open end normally for closure thereof but selectively removable in order to remove any accumulations of mercury in said trap line.

29. Mercury recovery apparatus as set forth in claim 23 wherein said filter means includes:

a perforated stainless steel disk similar in diameter to the outer diameter of said container overlying and proximate to the aperture in said lower closure member;

a chamois disk similar in diameter to the outer diameter of said container and contiguous with said perforated stainless steel disk;

a disk-shaped stainless steel screen similar in diameter to the outer diameter of said container and contiguous with said chamois disk;

said perforated stainless steel disk, said chamois disk, and said disk-shaped stainless steel screen all being firmly held in contiguous relationship when said lower threaded closure member is tightened into threaded engagement with said lower end of said container.

30. A precious metal recovery system as set forth in claim 23 including retort and distillation means for receiving the precious metal amalgam from said filter means of said air tort and removing the mercury from the amalgam thereby resulting in a substantially pure form of the precious metal.

* * * * *